United States Patent [19]

Kingston

[11] 4,313,994

[45] Feb. 2, 1982

[54] HEAT TRANSFER LABELING

[75] Inventor: Katherine A. Kingston, Belmont, Mass.

[73] Assignee: Dennison Manufacturing Company, Framingham, Mass.

[21] Appl. No.: 87,912

[22] Filed: Oct. 24, 1979

[51] Int. Cl.[3] ..... B41M 3/12; B41M 5/26

[52] U.S. Cl. ..... 428/200; 156/240; 156/277; 427/148; 427/265; 428/202; 428/207; 428/347; 428/349; 428/352; 428/913; 428/914

[58] Field of Search ..... 156/234, 239, 240, 247, 156/277; 427/148, 261, 265; 428/195, 200, 203, 204, 207, 913, 914, 202, 347, 352, 354, 40–42, 348, 349

[56] References Cited

U.S. PATENT DOCUMENTS 3,508,754 4/1970 Shorin ..... 428/352

3,922,435 11/1975 Asnes ..... 156/240 X

*Primary Examiner*—Bruce H. Hess

*Attorney, Agent, or Firm*—George E. Kersey

[57] ABSTRACT

Product and process for heat transfer labeling employing a contoured thermoplastic and resinous release layer which is desirably imprinted on a carrier and superimposed with a transfer layer containing a design print.

11 Claims, 7 Drawing Figures

HEAT TRANSFER LABELING

BACKGROUND OF THE INVENTION

This invention relates to the labeling of objects by the use of heat to transfer design prints from a carrier to the objects being labeled.

In heat transfer labeling, a design print that is affixed to a carrier by a release layer is brought into contact with an object to be labeled. When heat is applied to the carrier the release layer becomes molten and permits the design print to become adhered to the object.

In the typical heat transfer label, as exemplified by U.S. Pat. No. 3,616,015, which issued Oct. 26, 1971, the release layer is a coating of wax on the carrier and the design print is in a transfer layer that is printed on the wax coating. With such a label, the application of heat during the transfer process causes a film of wax to be deposited over the entire region where the carrier is in contact with the object being labeled. The deposited film is of random configuration and is frequently much larger than the design print.

Although the wax film is transparent and generally not noticeable by casual observation, under certain lighting conditions the film is viewable and can present an objectionable appearance. The resulting film can be regarded as an expanded, irregular "halo" that surrounds the design print. Not only can the irregular halo present an objectionable appearance, it represents a wastage of material. Moreover, because of the tendency of the wax to penetrate the carrier material used in ordinary heat transfer labeling, a substantial amount of wax material is needed to form the transfer coating.

Accordingly it is an object of the invention to expedite and facilitate the heat transfer labeling of objects.

Another object of the invention is to improve the appearance of heat transfer labels. A related object is to eliminate the enlarged, irregular halo often encountered in heat transfer labeling.

A related object is to economize on the amount of material needed for the release layer in the heat transfer labeling of objects.

SUMMARY OF THE INVENTION

In accomplishing the foregoing and related objects, the invention provides for the use of a thermoplastic release layer containing a repellent material such as silicone. The release layer is contoured in accordance with a prescribed pattern and is in registration with a transfer layer.

Since the release layer is contoured, it does not present an irregular appearance. Further the contoured pattern can be made to closely approximate the contour of the transfer layer and thereby significantly reduce the extent of the halo.

In accordance with one aspect of the invention the halo can be completely eliminated by having the confines of the transfer layer exceed those of the release layer.

In accordance with a further aspect of the invention the release layer is applied by printing, instead of coating the carrier. This significantly reduces the amount of material needed. In addition when the release material is a resin, as opposed to a wax, there is less absorption by the carrier and less material is needed.

Printing of the release layer also eliminates the need for a coating operation in conjunction with the printing operation by which the transfer layer is applied to the carrier.

DESCRIPTION OF THE DRAWINGS

Although aspects of the invention will become apparent after considering several illustrative embodiments taken in conjunction with the drawings in which.

DETAILED DESCRIPTION

Figure 1A:
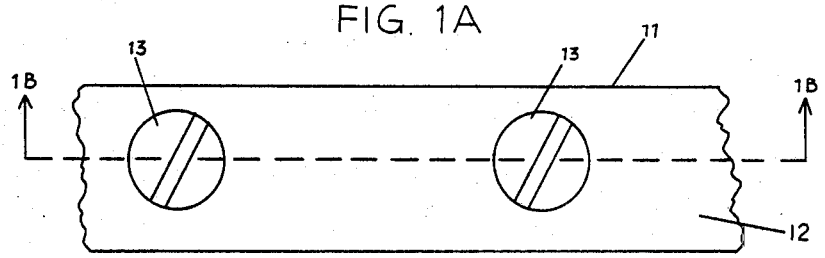
FIG. 1A is a plan view of heat transfer label carrier of the prior art.
Figure 1B:
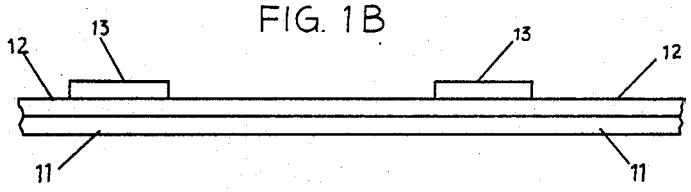
FIG. 1B is a sectional view of the carrier of FIG. 1A.
Figure 1C:
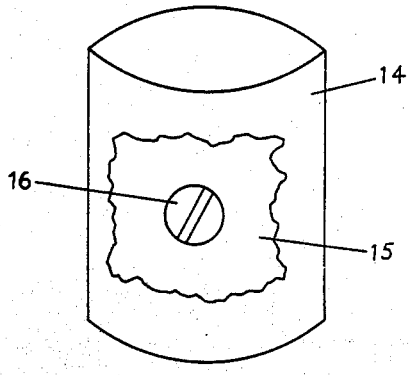
FIG. 1C is a perspective view of an object that has been labeled using the carrier of FIG. 1A.

With reference to FIGS. 1A through 1C of the drawings, a carrier 11 (FIGS. 1A and 1B) in accordance with the prior art is provided with a coating 12 upon which is superimposed a transfer layer 13 which includes a design print.

When the transfer layer 13 of the carrier 11 is brought into contact with an object to be labeled, such as the illustrative container 14 of FIG. 1C, and heat is applied, the wax coating 12 melts and allows the contacting portion of the transfer layer 13 to adhere to the container 14. Simultaneously a wax film 15 is deposited on the container 14. This film is of irregular configuration and considerably larger than the transferred design print 16. Under certain viewing conditions the film 15 presents an objectionable appearance.

Figure 2A:
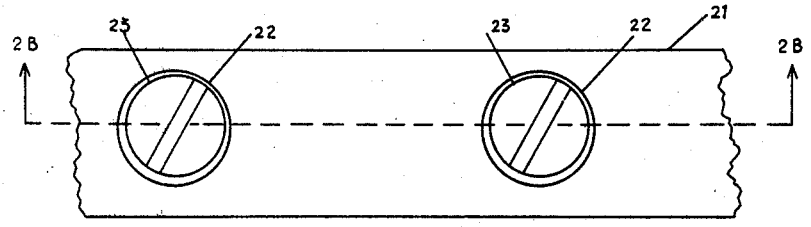
FIG. 2A is a plan view of a heat transfer label carrier in accordance with the invention.
Figure 2B:
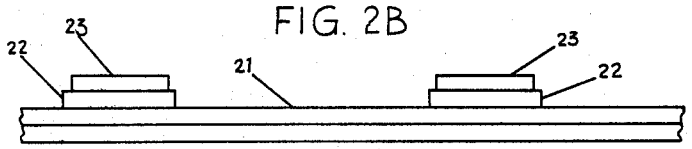
FIG. 2B is a sectional view of the carrier of FIG. 2A.
Figure 2C:
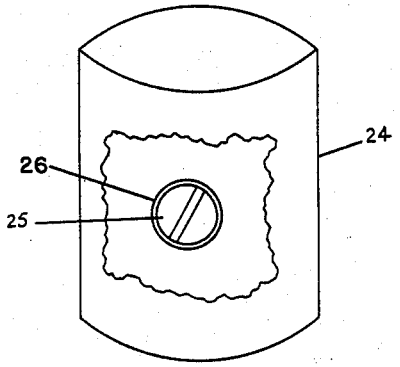
FIG. 2C is a perspective view of an object that has been labeled using the carrier of FIG. 2A.

To remedy the foregoing difficulties, the invention provides the heat transfer labeling arrangement of FIGS. 2A and 2B in which a contoured release layer 22 is applied to the carrier 21 and a transfer layer 23 is superimposed on the release layer. As a result, when the transfer layer 23 is brought into contact with an object to be labeled, such as the illustrative container 24 of FIG. 2C, the transferred design print 25 has superimposed on it a release layer which provides a contoured halo 26 with a narrow margin.

Figure 3:
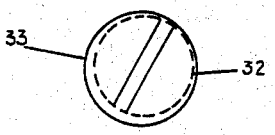
FIG. 3 is a plan view of an alternative heat transfer label in accordance with the invention.

If it is desired to eliminate even the narrow halo 26, this can be done, as shown in FIG. 3, by forming the heat transfer label with a contoured release layer 32 that is within the confines of a transfer layer 33. When this label is applied to an object the design print from the transfer layer 33 is coextensive with the boundaries of release layer 32.

The release layers 22 and 32 are applied to a carrier by printing. For that purpose suitable materials are soluble resins such as polyamides, polystyrenes, rosin derivatives, phenol formaldehydes, terpene resins and ketone resins. Suitable solvents include alcohols and toluenes, and various mixtures of the same. A small amount of glycerine is added to achieve repellency, i.e. non-tackiness in the finished product. A suitable material for the transfer layers 23 and 33 is the resin isobutylmethacrylate, which desirably has a low melt viscosity in the range from 3.5 to 8.5 poises at 160 degrees centrigrade, and a softening point in the range from 95° to 106° C.

The practice of the invention is further illustrated with reference to the following non-limiting examples:

EXAMPLE I

A polyamide resin sold and marketed under the trade name EMEREZ 1538 of Emery Industries was dissolved in 70 parts isopropyl alcohol and 30 parts toluene to form a solution with a concentration of 30 percent resin. To this is added silicone in the range between 1 and 5 percent. The resulting solution is printed in a contoured pattern on a paper carrier of conventional bodystock for heat transfer labeling using a rotogravure press. The print pattern is dried to remove the solvent and overprinted with a transfer layer, formed by an ink lacquer of isobutylmethacrylate, in a contoured pattern in registration with the release pattern. The doubly imprinted carrier stock is used to apply the design print of the ink lacquer to an object to afford good transfer with an insignificant release halo and suitable repellency.

Other appropriate polyamide resins of the EMEREZ type are sold and marketed under the trade names EMEREZ 1536 and 1537.

EMEREZ polyamide resins have the characteristics illustrated in TABLE I, below.

TABLE I

| CHARACTERISTIC | EMEREZ 1536 | EMEREZ 1538 |
|---|---|---|
| Softening point range (degrees centigrade) | 95–105 | 98–106 |
| Melt Viscosity (poise at 160 degrees centigrade) | 3.5–5.0 | 6.5–8.5 |
| Molten Color (1963 Gardner) | 12 | 10 |
| Viscosity in 40% Mixed Solvent (cps at 25° C.) | 66 | 82 |
| Viscosity in 40% n-Propanol (cps at 25° C.) | 62 | 95 |

EXAMPLE II

Example I is repeated using a polyamide sold and marketed under the trade name VERSAMID 940 by General Mills. Satisfactory release is afforded with an insignificant release halo.

EXAMPLE II

Example I is repeated using a polyamide sold and marketed under the trade name VERSAMID 948. Satisfactory release is afforded.

EXAMPLE IV

Example I is repeated using a polystyrene resin sold and marketed under the trade name LUSTREX 3 using toluene as the solvent. Satisfactory release is afforded with an insignificant release halo.

EXAMPLE V

Example IV is repeated with a similar result using a rosin derivative sold and marketed under the trade name PENTALYN A.

EXAMPLE VI

Example IV is repeated with a similar result using a modified phenol formaldehyde sold and marketed under the trade name AMBEROL F-7.

EXAMPLE VII

Example IV is repeated with a similar result using a terpene resin sold and marketed under the trade name PICCOLYTE S-100.

EXAMPLE VIII

Example IV is repeated with a similar result using a ketone resin sold and marketed under the trade name ADVARESIN CXF.

It will be understood that the foregoing examples and description are illustrative only and that other examples and equivalents within the spirit and scope of the invention will occur to those skilled in the art.

I claim:

1. A label for heat transfer labeling comprising a carrier;

an imprinted, discontinuous, thermoplastic and resinous release layer on said carrier, said layer containing a repellent thermoplastic silicone material therein; and a transfer layer, including a design superimposed upon continuous portions of said release layer which is discontinuous elsewhere;

said release layer having continuous portions, each with a border in conformity with the design of the transfer layer superimposed thereon;

said release layer being carried with said transfer layer during the heat transfer step.

2. A label for heat transfer labeling comprising a carrier; an imprinted, discontinuous, thermoplastic and resinous release layer on said carrier; and a transfer layer, including a design pattern superimposed upon a continuous portion of said release layer, which is discontinuous elsewhere; the continuous portion of said release layer underlying each design pattern having a closed border which is substantially the same as an exterior closed border of the design pattern;

said release layer being carried with said transfer layer during the heat transfer step.

3. A label for heat transfer labeling comprising a carrier; an imprinted, discontinuous, thermoplastic and resinous release layer on said carrier; and a transfer layer, including a design pattern superimposed upon a continuous portion of said release layer, which is discontinuous elswehere; the continuous portion of said release layer underlying said design pattern having a closed border which is substantially parallel with an exterior closed border of the design pattern;

said release layer being carried with said transfer layer during the heat transfer step.

4. A label as defined in any of claims 1–3 wherein the release layer and the transfer layer are approximately co-terminus and have an outline differing from that of the carrier.

5. A label as defined in any of claims 1–3 wherein said release layer has a margin with respect to the contour of said transfer layer.

6. A label as defined in any of claims 1–3 wherein said transfer layer has a margin with respect to the contour of said release layer.

7. A label as defined in claim 1 wherein said release layer has a melt viscosity in the range from 3.5 to 8.5 poises at 160° C.

8. A label as defined in claim 1 wherein said release layer has a softening point in the range from 95° to 106° C.

9. A label as defined in claim 1 wherein said release layer is a polyamide or a polystyrene resin or a rosin derivative or phenol formaldehyde resin or a terpene resin or a ketone resin or a mixture thereof.

10. A method of manufacturing a heat transfer label as defined in claim 1 which comprises the steps of (a) dissolving the material of the release layer in a solvent to form a solution;

(b) printing said solution onto a carrier; and (c) printing the transfer layer onto the release layer.

11. A method of labeling an object with a label as defined in claim 1 which comprises the steps of (a) applying said label to said object;

(b) heating said label to cause the release layer to soften and be removable from said carrier; and (c) transferring said transfer layer to said object with said release layer superimposed thereon and approximately co-terminus therewith.

* * * * *